US006448521B1

(12) United States Patent
Castonguay et al.

(10) Patent No.: US 6,448,521 B1
(45) Date of Patent: Sep. 10, 2002

(54) BLOCKING APPARATUS FOR CIRCUIT BREAKER CONTACT STRUCTURE

(75) Inventors: Roger N. Castonguay, Terryville; James L. Rosen, West Hartford, both of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/516,568

(22) Filed: Mar. 1, 2000

(51) Int. Cl.[7] ..... H01H 5/00

(52) U.S. Cl. ..... 200/400; 200/318; 335/16; 335/172

(58) Field of Search ..... 200/17 R, 400, 200/401, 501, 244, 321–325, 336, 337, 50.01, 318, 50.32–50.35; 218/22, 30–33, 146, 152, 153, 7, 14; 335/16, 147, 195, 8–10, 172

(56) References Cited

U.S. PATENT DOCUMENTS

| | | | | |
|---|---|---|---|---|
| 2,340,682 | A | 2/1944 | Powell | 200/147 |
| 2,719,203 | A | 9/1955 | Gelzheiser et al. | 200/144 |
| 2,937,254 | A | 5/1960 | Ericson | 200/114 |
| 3,158,717 | A | 11/1964 | Jencks et al. | 200/116 |
| 3,162,739 | A | 12/1964 | Klein et al. | 200/88 |
| 3,197,582 | A | 7/1965 | Norden | 200/50 |
| 3,307,002 | A | 2/1967 | Cooper | 200/116 |
| 3,517,356 | A | 6/1970 | Hanafusa | 335/16 |
| 3,631,369 | A | 12/1971 | Menocal | 337/110 |
| 3,803,455 | A | 4/1974 | Willard | 317/33 SC |
| 3,883,781 | A | 5/1975 | Cotton | 317/14 R |
| 4,128,750 | A | 12/1978 | Castonquay et al. | |
| 4,129,762 | A | 12/1978 | Bruchet | 200/153 G |
| 4,144,513 | A | 3/1979 | Shafer et al. | 335/46 |
| 4,158,119 | A | 6/1979 | Krakik | 200/240 |
| 4,165,453 | A | 8/1979 | Hennemann | 200/153 G |
| 4,166,988 | A | 9/1979 | Ciarcia et al. | 335/9 |
| 4,220,934 | A | 9/1980 | Wafer et al. | 335/16 |
| 4,255,732 | A | 3/1981 | Wafer et al. | 335/16 |
| 4,259,651 | A | 3/1981 | Yamat | 335/16 |
| 4,263,492 | A | 4/1981 | Maier et al. | 200/288 |
| 4,276,527 | A | 6/1981 | Gerbert-Gaillard et al. | 335/39 |

(List continued on next page.)

FOREIGN PATENT DOCUMENTS

| | | | |
|---|---|---|---|
| BE | 819 008 A | 12/1974 | H01F/00/00 |
| BE | 897 691 A | 12/1974 | |
| DE | 12 27 978 | 11/1966 | |
| DE | 30 47 360 | 6/1982 | H01H/85/20 |
| DE | 38 02 184 | 8/1989 | H01H/3/46 |
| DE | 38 43 277 | 6/1990 | H02H/3/08 |
| DE | 44 19 240 | 1/1995 | H01H/9/10 |
| EP | 0 061 092 | 9/1982 | G03G/5/14 |
| EP | 0 064 906 | 11/1982 | H01H/71/74 |
| EP | 0 066 486 | 12/1982 | H01H/71/92 |
| EP | 0 076 719 | 4/1983 | H01H/71/74 |
| EP | 0 117 094 | 8/1984 | H01H/71/10 |
| EP | 0 140 761 | 5/1985 | H01H/71/52 |
| EP | 0 174 904 | 3/1986 | H01H/9/20 |
| EP | 0 196 241 | 10/1986 | H01H/71/00 |

(List continued on next page.)

*Primary Examiner*—Michael Friedhofer
(74) *Attorney, Agent, or Firm*—Cantor Colburn LLP; Carl B. Horton

(57) ABSTRACT

A blocking apparatus for blocking a contact structure from closing in a circuit breaker is provided. The apparatus includes a link extending from the circuit breaker and connected to a movable contact arm. The contact structure, being operated by an operating mechanism, remains in a separated position even when the operating mechanism is in the "ON" position due to the connection with the link of the blocking apparatus. A release assembly releases the link when it is desired to close the movable contact arm.

16 Claims, 10 Drawing Sheets

U.S. PATENT DOCUMENTS

| | | | | |
|---|---|---|---|---|
| 4,297,663 | A | 10/1981 | Seymour et al. | 335/20 |
| 4,301,342 | A | 11/1981 | Castonguay et al. | 200/153 SC |
| 4,360,852 | A | 11/1982 | Gilmore | 361/98 |
| 4,368,444 | A | 1/1983 | Preuss et al. | 335/166 |
| 4,375,021 | A | 2/1983 | Pardini et al. | 200/147 B |
| 4,375,022 | A | 2/1983 | Daussin et al. | 200/148 R |
| 4,376,270 | A | 3/1983 | Staffen | 335/21 |
| 4,383,146 | A | 5/1983 | Bur | 200/17 R |
| 4,392,036 | A | 7/1983 | Troebel et al. | 200/322 |
| 4,393,283 | A | 7/1983 | Masuda | 200/51.09 |
| 4,401,872 | A | 8/1983 | Boichot-Castagne et al. | 200/153 G |
| 4,409,573 | A | 10/1983 | DiMarco et al. | 335/16 |
| 4,435,690 | A | 3/1984 | Link et al. | 335/37 |
| 4,467,297 | A | 8/1984 | Boichot-Castagne et al. | 335/8 |
| 4,468,645 | A | 8/1984 | Gerbert-Gaillard et al. | 335/42 |
| 4,470,027 | A | 9/1984 | Link et al. | 335/16 |
| 4,479,143 | A | 10/1984 | Watanabe et al. | 358/44 |
| 4,488,133 | A | 12/1984 | McClellan et al. | 335/16 |
| 4,492,941 | A | 1/1985 | Nagel | 335/13 |
| 4,541,032 | A | 9/1985 | Schwab | 361/331 |
| 4,546,224 | A | 10/1985 | Mostosi | 200/153 G |
| 4,550,360 | A | 10/1985 | Dougherty | 361/93 |
| 4,562,419 | A | 12/1985 | Preuss et al. | 335/195 |
| 4,589,052 | A | 5/1986 | Dougherty | 361/94 |
| 4,595,812 | A | 6/1986 | Tamaru et al. | 200/307 |
| 4,611,187 | A | 9/1986 | Banfi | 335/16 |
| 4,612,430 | A | 9/1986 | Sloan et al. | 200/327 |
| 4,616,198 | A | 10/1986 | Pardini | 335/16 |
| 4,622,444 | A | 11/1986 | Kandatsu et al. | 200/303 |
| 4,631,625 | A | 12/1986 | Alexander et al. | 361/94 |
| 4,642,431 | A | 2/1987 | Tedesco et al. | 200/153 G |
| 4,644,438 | A | 2/1987 | Puccinelli et al. | 361/75 |
| 4,649,247 | A | 3/1987 | Preuss et al. | 200/244 |
| 4,658,322 | A | 4/1987 | Rivera | 361/37 |
| 4,672,501 | A | 6/1987 | Bilac et al. | 361/96 |
| 4,675,481 | A | 6/1987 | Markowski et al. | 200/144 R |
| 4,682,264 | A | 7/1987 | Demeyer | 361/96 |
| 4,689,712 | A | 8/1987 | Demeyer | 361/96 |
| 4,694,373 | A | 9/1987 | Demeyer | 361/96 |
| 4,710,845 | A | 12/1987 | Demeyer | 361/96 |
| 4,717,985 | A | 1/1988 | Demeyer | 361/96 |
| 4,733,211 | A | 3/1988 | Castonguay et al. | 335/192 |
| 4,733,321 | A | 3/1988 | Lindeperg | 361/96 |
| 4,764,650 | A | 8/1988 | Bur et al. | 200/153 G |
| 4,768,007 | A | 8/1988 | Mertz et al. | 335/202 |
| 4,780,786 | A | 10/1988 | Weynachter et al. | 361/87 |
| 4,831,221 | A | 5/1989 | Yu et al. | 200/553 |
| 4,870,531 | A | 9/1989 | Danek | 361/93 |
| 4,883,931 | A | 11/1989 | Batteux et al. | 200/148 R |
| 4,884,047 | A | 11/1989 | Baginski et al. | 335/10 |
| 4,884,164 | A | 11/1989 | Dziura et al. | 361/97 |
| 4,900,882 | A | 2/1990 | Bernard et al. | 200/147 R |
| 4,910,485 | A | 3/1990 | Bolongeat-Mobleu et al. | 335/195 |
| 4,914,541 | A | 4/1990 | Tripodi et al. | 361/94 |
| 4,916,420 | A | 4/1990 | Bartolo et al. | 335/172 |
| 4,916,421 | A | 4/1990 | Pardini et al. | 335/185 |
| 4,926,282 | A | 5/1990 | McGhie | 361/102 |
| 4,935,590 | A | 6/1990 | Malkin et al. | 200/148 A |
| 4,935,712 | A | 6/1990 | Oyama et al. | |
| 4,937,706 | A | 6/1990 | Schueller et al. | 361/396 |
| 4,939,492 | A | 7/1990 | Raso et al. | 335/42 |
| 4,943,691 | A | 7/1990 | Mertz et al. | 200/151 |
| 4,943,888 | A | 7/1990 | Jacob et al. | 361/96 |
| 4,950,855 | A | 8/1990 | Bolonegeat-Mobleu et al. | 200/148 A |
| 4,951,019 | A | 8/1990 | Gula | 335/166 |
| 4,952,897 | A | 8/1990 | Barnel et al. | 335/147 |
| 4,958,135 | A | 9/1990 | Baginski et al. | 335/8 |
| 4,965,543 | A | 10/1990 | Batteux | 335/174 |
| 4,983,788 | A | 1/1991 | Pardini | 200/16 R |
| 5,001,313 | A | 3/1991 | Leclerq et al. | 200/148 B |
| 5,004,878 | A | 4/1991 | Seymour et al. | 200/144 R |
| 5,029,301 | A | 7/1991 | Nebon et al. | 335/16 |
| 5,030,804 | A | 7/1991 | Abri | 200/323 |
| 5,057,655 | A | 10/1991 | Kersusan et al. | 200/148 B |
| 5,077,627 | A | 12/1991 | Fraisse | 361/93 |
| 5,083,081 | A | 1/1992 | Barrault et al. | 324/126 |
| 5,095,183 | A | 3/1992 | Raphard et al. | 200/148 A |
| 5,103,198 | A | 4/1992 | Morel et al. | 335/6 |
| 5,115,371 | A | 5/1992 | Tripodi | 361/106 |
| 5,120,921 | A | 6/1992 | DiMarco et al. | 200/401 |
| 5,132,865 | A | 7/1992 | Mertz et al. | 361/6 |
| 5,138,121 | A | 8/1992 | Streich et al. | 200/293 |
| 5,140,115 | A | 8/1992 | Morris | 200/308 |
| 5,153,802 | A | 10/1992 | Mertz et al. | 361/18 |
| 5,155,315 | A | 10/1992 | Malkin et al. | 200/148 R |
| 5,166,483 | A | 11/1992 | Kersusan et al. | 200/144 A |
| 5,172,087 | A | 12/1992 | Castonguay et al. | 335/160 |
| 5,178,504 | A | 1/1993 | Falchi | 411/553 |
| 5,184,717 | A | 2/1993 | Chou et al. | 200/401 |
| 5,187,339 | A | 2/1993 | Lissandrin | 200/148 F |
| 5,198,956 | A | 3/1993 | Dvorak | 361/106 |
| 5,200,724 | A | 4/1993 | Gula et al. | 335/166 |
| 5,210,385 | A | 5/1993 | Morel et al. | 200/146 R |
| 5,239,150 | A | 8/1993 | Bolongeat-Mobleu et al. | 200/148 R |
| 5,260,533 | A | 11/1993 | Livesey et al. | 200/401 |
| 5,262,744 | A | 11/1993 | Arnold et al. | 335/8 |
| 5,280,144 | A | 1/1994 | Bolongeat-Mobleu et al. | 200/148 R |
| 5,281,776 | A | 1/1994 | Morel et al. | 200/144 |
| 5,296,660 | A | 3/1994 | Morel et al. | 200/146 R |
| 5,296,664 | A | 3/1994 | Crookston et al. | 200/401 |
| 5,298,874 | A | 3/1994 | Morel et al. | 335/8 |
| 5,300,907 | A | 4/1994 | Nereau et al. | 335/172 |
| 5,310,971 | A | 5/1994 | Vial et al. | 200/244 |
| 5,313,180 | A | 5/1994 | Vial et al. | 335/16 |
| 5,317,471 | A | 5/1994 | Izoard et al. | 361/105 |
| 5,331,500 | A | 7/1994 | Corcoles et al. | 361/93 |
| 5,334,808 | A | 8/1994 | Bur et al. | 200/50 |
| 5,341,191 | A | 8/1994 | Crookston et al. | 335/16 |
| 5,347,096 | A | 9/1994 | Bolongeat-Mobleu et al. | 200/148 B |
| 5,347,097 | A | 9/1994 | Bolongeat-Mobleu et al. | 200/148 B |
| 5,350,892 | A | 9/1994 | Rozier | 200/144 B |
| 5,357,066 | A | 10/1994 | Morel et al. | 200/17 R |
| 5,357,068 | A | 10/1994 | Rozier | 200/148 R |
| 5,357,394 | A | 10/1994 | Piney | 361/72 |
| 5,361,052 | A | 11/1994 | Ferullo et al. | 335/172 |
| 5,373,130 | A | 12/1994 | Barrault et al. | 200/147 R |
| 5,379,013 | A | 1/1995 | Coudert | 335/17 |
| 5,424,701 | A | 6/1995 | Castonguary et al. | 335/172 |
| 5,438,176 | A | 8/1995 | Bonnardel et al. | 200/400 |
| 5,440,088 | A | 8/1995 | Coudert et al. | 200/303 |
| 5,449,871 | A | 9/1995 | Batteux et al. | 200/401 |
| 5,450,048 | A | 9/1995 | Leger et al. | 335/132 |
| 5,451,729 | A | 9/1995 | Onderka et al. | 200/18 |
| 5,457,295 | A | 10/1995 | Tanibe et al. | 200/293 |
| 5,467,069 | A | 11/1995 | Payet-Burin et al. | 335/42 |
| 5,469,121 | A | 11/1995 | Payet-Burin | 335/16 |
| 5,475,558 | A | 12/1995 | Barjonnet et al. | 361/64 |
| 5,477,016 | A | 12/1995 | Baginski et al. | 200/43.11 |
| 5,479,143 | A | 12/1995 | Payet-Burin | 335/202 |
| 5,483,212 | A | 1/1996 | Lankuttis et al. | 335/132 |
| 5,485,343 | A | 1/1996 | Santos et al. | 361/115 |
| D367,265 | S | 2/1996 | Yamagata et al. | D13/160 |
| 5,493,083 | A | 2/1996 | Olivier | 200/17 R |
| 5,504,284 | A | 4/1996 | Lazareth et al. | 200/50 R |

| | | | | |
|---|---|---|---|---|
| 5,504,290 | A | 4/1996 | Baginski et al. | 200/401 |
| 5,510,761 | A | 4/1996 | Boder et al. | 335/172 |
| 5,512,720 | A | 4/1996 | Coudert et al. | 200/400 |
| 5,515,018 | A | 5/1996 | DiMarco et al. | 335/16 |
| 5,519,561 | A | 5/1996 | Mrenna et al. | 361/105 |
| 5,534,674 | A | 7/1996 | Steffens | 218/154 |
| 5,534,832 | A | 7/1996 | Duchemin et al. | 335/16 |
| 5,534,835 | A | 7/1996 | McColloch et al. | 335/172 |
| 5,534,840 | A | 7/1996 | Cuingnet | 337/1 |
| 5,539,168 | A | 7/1996 | Linzenich | 200/303 |
| 5,543,595 | A | 8/1996 | Mader et al. | 200/401 |
| 5,552,755 | A | 9/1996 | Fello et al. | 335/18 |
| 5,581,219 | A | 12/1996 | Nozawa et al. | 335/132 |
| 5,604,656 | A | 2/1997 | Derrick et al. | 361/187 |
| 5,608,367 | A | 3/1997 | Zoller et al. | 335/132 |
| 5,784,233 | A | 7/1998 | Bastard et al. | 361/36 |
| 6,031,438 | A * | 2/2000 | Runyan | 335/172 |
| 6,232,569 | B1 * | 5/2001 | Nakajima et al. | 200/400 |

FOREIGN PATENT DOCUMENTS

| | | | |
|---|---|---|---|
| EP | 0 224 396 | 6/1987 | H01H/71/52 |
| EP | 0 235 479 | 9/1987 | H02H/3/04 |
| EP | 0 239 460 | 9/1987 | H01H/33/24 |
| EP | 0 258 090 | 3/1988 | H02H/7/22 |
| EP | 0 264 313 | 4/1988 | H01H/83/04 |
| EP | 0 264 314 | 4/1988 | H01H/83/00 |
| EP | 0 283 189 | 9/1988 | H02B/13/02 |
| EP | 0 283 358 | 9/1988 | H02H/3/10 |
| EP | 0 291 374 | 11/1988 | H01H/83/20 |
| EP | 0 295 155 | 12/1988 | H01H/83/20 |
| EP | 0 295 158 | 12/1988 | H01H/71/52 |
| EP | 0 309 923 | 4/1989 | H01H/77/10 |
| EP | 0 313 106 | 4/1989 | H02B/13/02 |
| EP | 0 313 422 | 4/1989 | H02N/1/00 |
| EP | 0 314 540 | 5/1989 | H01H/1/20 |
| EP | 0 331 586 | 9/1989 | H01H/83/20 |
| EP | 0 337 900 | 10/1989 | H01H/71/32 |
| EP | 0 342 133 | 11/1989 | H01H/71/50 |
| EP | 0 367 690 | 5/1990 | H02H/3/04 |
| EP | 0 371 887 | 6/1990 | H01H/71/00 |
| EP | 0 375 568 | 6/1990 | H01H/71/02 |
| EP | 0 394 144 | 10/1990 | H01H/71/46 |
| EP | 0 394 922 | 10/1990 | H01H/1/20 |
| EP | 0 399 282 | 11/1990 | H01H/73/04 |
| EP | 0 407 310 | 1/1991 | H01H/3/347 |
| EP | 0 452 230 | 10/1991 | H02H/71/50 |
| EP | 0 555 158 | 8/1993 | H01H/71/52 |
| EP | 0 560 697 | 9/1993 | H01H/77/10 |
| EP | 0 567 416 | 10/1993 | H01H/9/26 |
| EP | 0 595 730 | 5/1994 | H01H/71/08 |
| EP | 0 619 591 | 10/1994 | H01H/71/40 |
| EP | 0 665 569 | 8/1995 | H01H/83/22 |
| EP | 0 700 140 | 3/1996 | H02H/3/33 |
| EP | 0 889 498 | 1/1999 | H01H/73/04 |
| FR | 2 410 353 | 6/1979 | H01H/51/24 |
| FR | 2 512 582 | 3/1983 | H01H/9/20 |
| FR | 2 553 943 | 4/1985 | H02H/3/33 |
| FR | 2 592 998 | 7/1987 | H02H/3/10 |
| FR | 2 682 531 | 4/1993 | H01H/71/00 |
| FR | 2 697 670 | 5/1994 | H01H/71/10 |
| FR | 2 699 324 | 6/1994 | H01H/51/27 |
| FR | 2 714 771 | 7/1995 | H01H/71/10 |
| GB | 2 233 155 | 1/1991 | H01H/1/50 |
| RU | 1 227 978 | 4/1986 | G01N/3/30 |
| WO | 92/00598 | 1/1992 | H01H/1/50 |
| WO | 92/05649 | 4/1992 | H04M/1/00 |
| WO | 94/00901 | 1/1994 | H02H/5/04 |
| WO | WO 99 62092 A | 12/1999 | H01H/73/04 |

* cited by examiner

BLOCKING APPARATUS FOR CIRCUIT BREAKER CONTACT STRUCTURE

BACKGROUND OF THE INVENTION

The present invention relates to circuit breakers, and more particularly to blocking apparatuses for circuit breaker contact structures.

Automatic circuit breakers of relatively high current carrying capacity utilize a movable contact arm assembly to carry the current. The movable contact arm assembly is generally separate from a complementary stationary contact by electromagnetic forces that overcome the holding force of contact springs (i.e., blow open forces), or, by other short-circuit conditions that signals an actuator to cause an operating mechanism to separate the contact via powerful mechanism operating springs and various links.

After the movable contact arm assembly is separated from the stationary contact, and the short-circuit condition is cleared, the electrical contact between the stationary and movable contacts must be closed and the operating mechanism reset. If the contact arm assembly separates via blow open forces, the operating mechanism remains in the "ON" position, unless the short-circuit condition also causes the actuator to trigger the operating mechanism, whereby the operating mechanism is in the "TRIPPED" position. Also, if the contact arm assembly separates via the operating mechanism, the operating mechanism is in the "TRIPPED" position.

In any of the above situations where the contact arm assembly is separated, no current flows through the circuit breaker. A handle integral with the operating mechanism must be moved beyond the "OFF" position prior to being returned to the "ON" position and having the contact arm assembly in electrical contact with the stationary contacts.

Is often desirable to close the movable contact assembly very rapidly. With conventional operating mechanism configurations, this requires a high speed and high torque force applied to the handle of the operating mechanism to reposition the operating mechanism springs. This high speed and high torque force may be provided manually, or maybe provided by a motorized charging mechanism. The speed of contact closure depends on the speed that the high torque force is applied, i.e., by a motorized charging mechanism.

SUMMARY OF THE INVENTION

An apparatus is provided that blocks a movable contact from being in electrical contact with a stationary contact in a circuit breaker contact structure. The circuit breaker contact structure interacts with an operating mechanism. The operating mechanism provides a closing force to move the movable contact into connection with the stationary contact. The apparatus includes a link connected to the movable contact, the link moving between a first position and a second position. The first position of the link holds the movable contact away from stationary contact against the closing force of the operating mechanism. The second position of the link releases the movable contact so that the closing force of the operating mechanism moves the movable contact into connection with the stationary contact.

DESCRIPTION OF THE PREFERRED EMBODIMENT

Figure 1:
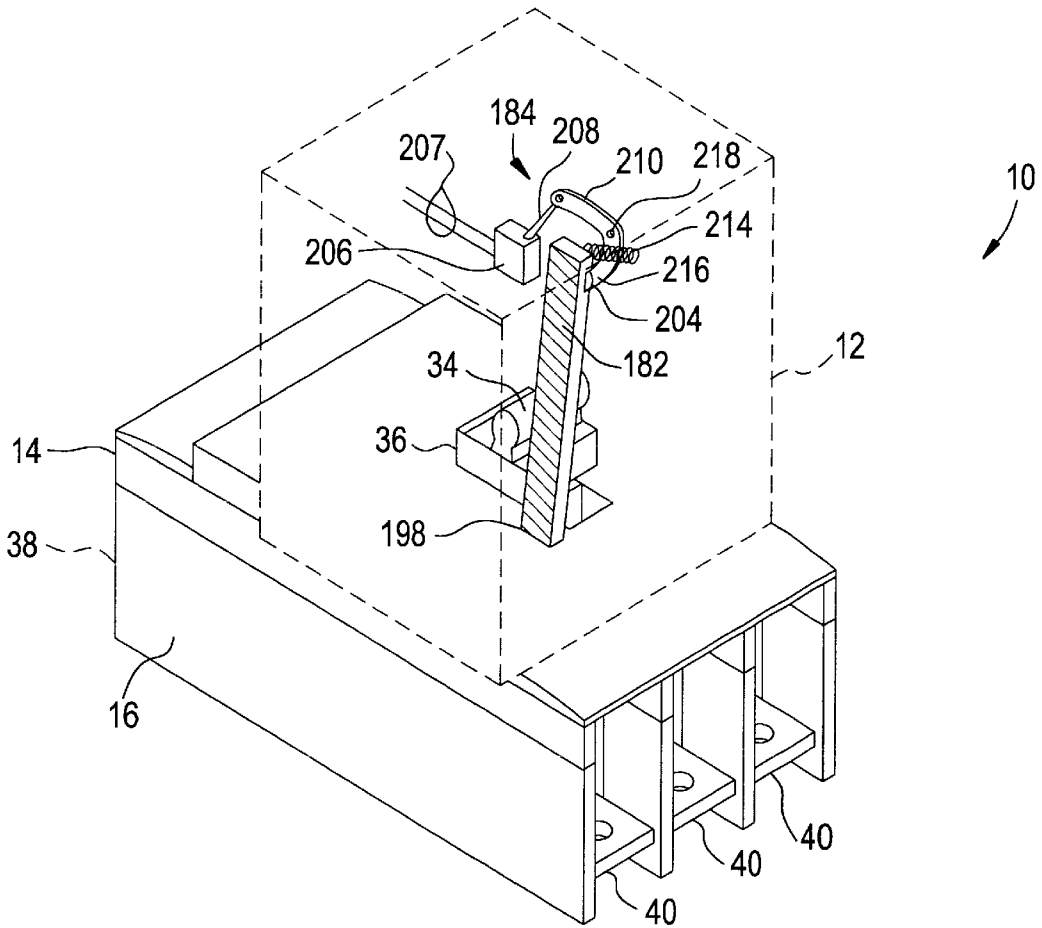
FIG. 1 is an isometric view of a circuit breaker employing a blocking apparatus embodied by present invention.
Figure 2:
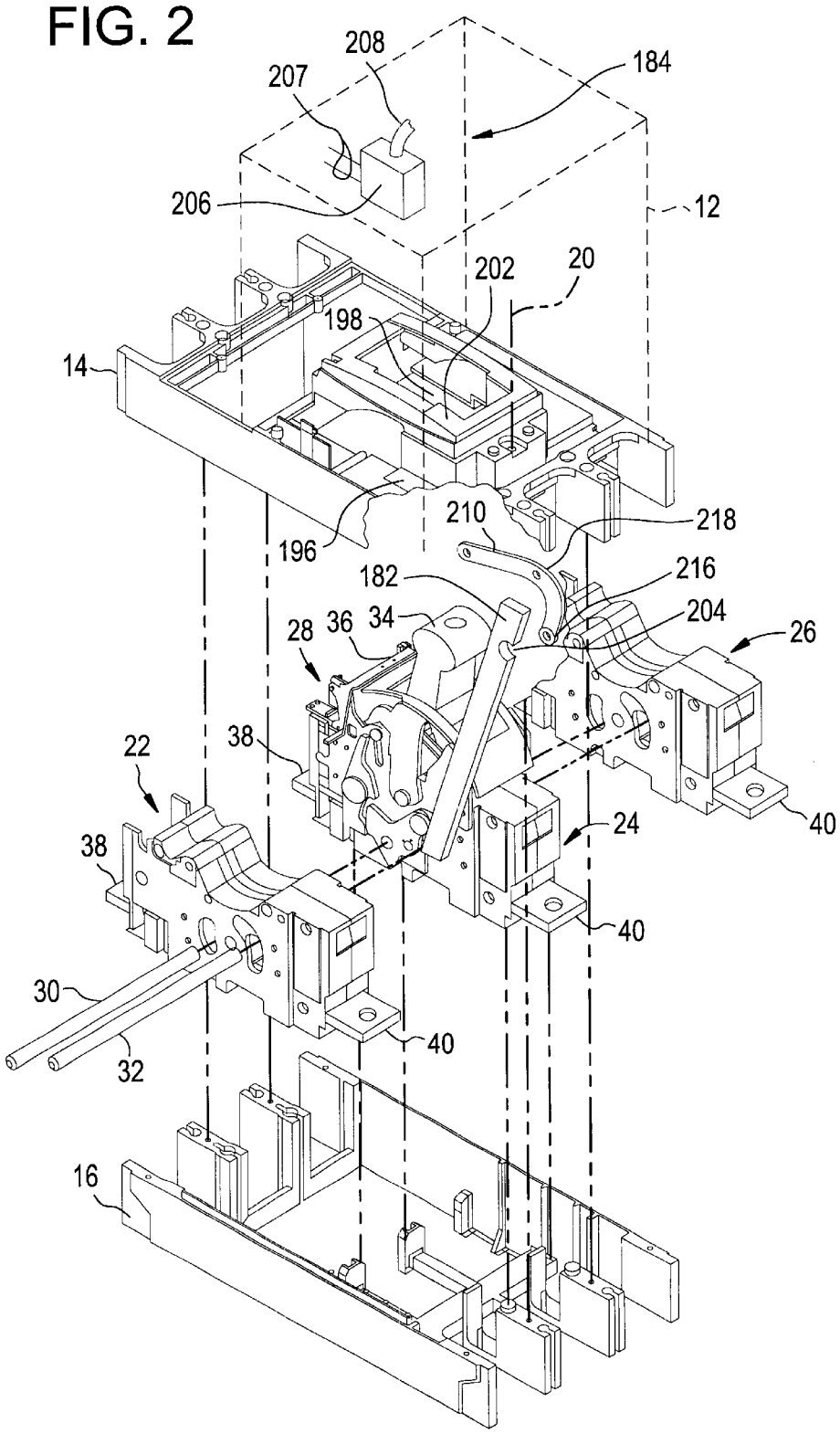
FIG. 2 is an exploded view of the circuit breaker employing the apparatus of the present invention.

A circuit breaker 10 is shown in FIGS. 1 and 2 that includes molded case having an apparatus frame top cover 12 (shown by dashed lines) attached to a mid cover 14. Mid cover 14 is coupled to a base 16. A series of cassettes 22, 24 and 26, generally having a rotary contact structure, are disposed within base 16. The operation of cassettes 22, 24 and 26 is described in more detail, for example, in U.S. patent application Ser. Nos. 09/087,038 and 09/384,908, both entitled "Rotary Contact Assembly For High-Ampere Rated Circuit Breakers", and U.S. patent application Ser. No. 09/384,495, entitled "Supplemental Trip Unit For Rotary Circuit Interrupters".

Referring to FIG. 2, a circuit breaker operating mechanism 28 is typically positioned over cassette 24 (intermediate to cassette 22 and 26) to control cassettes 22, 24 and 26 via a set of cross pins 30, 32. Operating mechanism 28 includes a toggle 34 extending through mid cover 14 to provide control of cassettes 22, 24 and 26.

For motorized operation of toggle 34, a charging mechanism 36 is provided. Charging mechanism 36 is typically a motor controlled device that provides the force required to rotate toggle 34, generally substituting a manual force. Charging mechanism 36 can be, for example, a screw actuator, a ball screw actuator or a cable actuator capable of applying a force to toggle 34.

Referring now to FIGS. 3–6, operating mechanism 28 generally includes latches and linkages for holding and releasing a set of powerful mechanism operating springs 64, which interface with rotary contact structures within cassettes 22, 24 and 26 (described herein). Furthermore, operating mechanism 28 typically interfaces with an actuator (not shown), wherein the actuator displaces a secondary latch trip tab 108 within operating mechanism 28, for example, in response to a signal generated as a result of a short circuit condition or remote operation.

The displacement of secondary latch trip tab 108 releases the latches and linkage holding mechanism operating springs 64. Examples of operating mechanism 28 include those described in U.S. patent application Ser. No. 09/196,706, entitled "Circuit Breaker Mechanism For A Rotary Contact System", U.S. patent application Ser. No. 09/516,475 entitled "Circuit Interrupter Operating Mechanism", and U.S. application Ser. No. 09/087,038, entitled "Rotary Contact Assembly for High Ampere-Rated Circuit Breakers".

Figure 3:
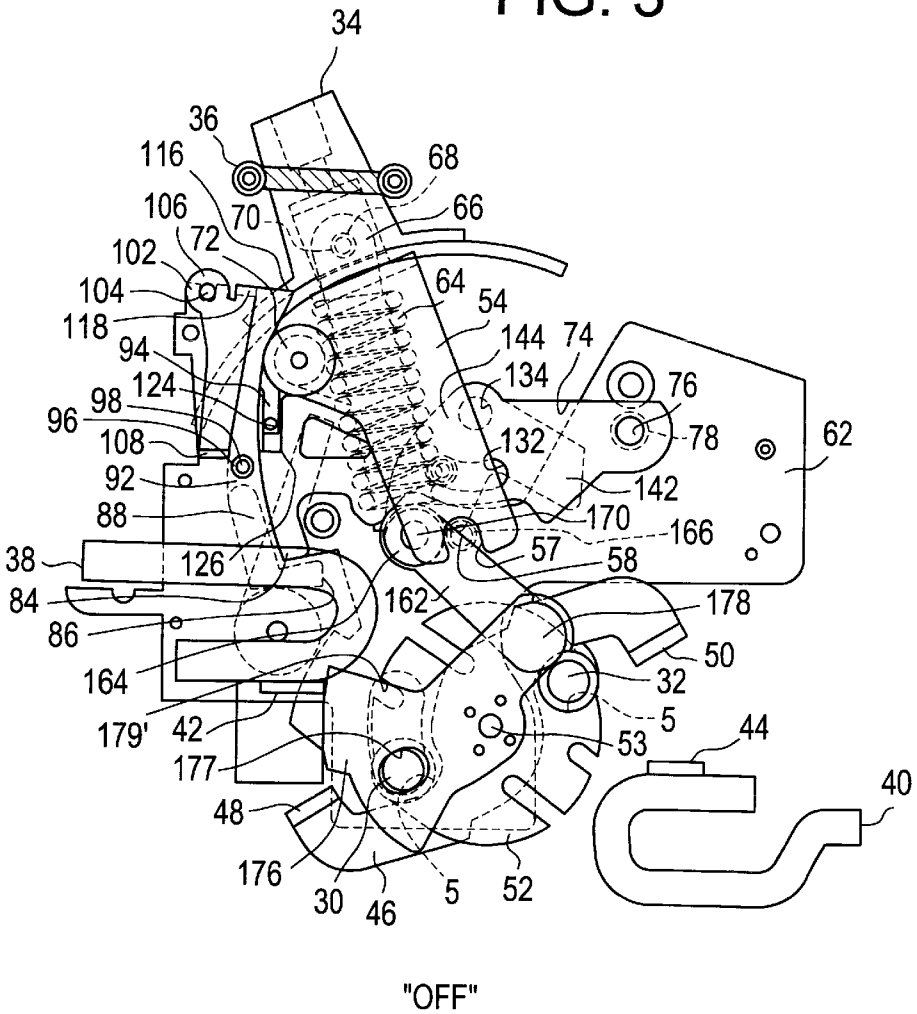
FIG. 3 is a sectional view of a circuit breaker shown in the "OFF" position without the blocking apparatus of the present invention.
Figure 7:
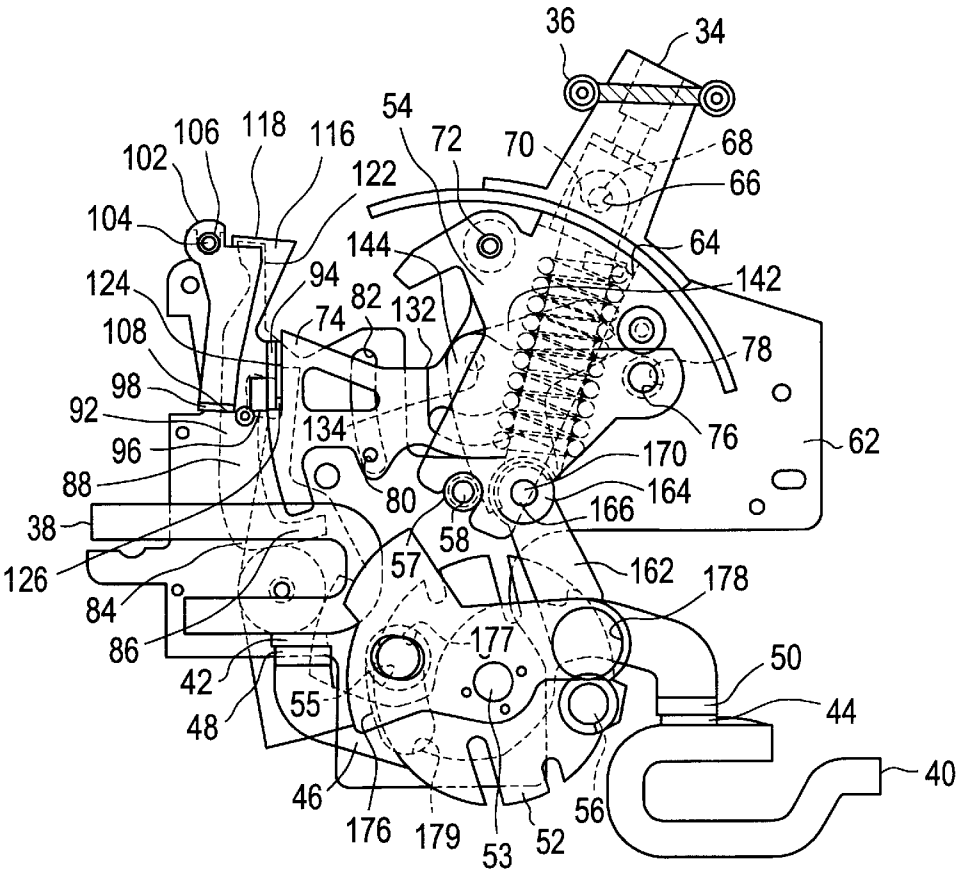
FIG. 7 is a sectional view of the circuit breaker of FIG. 3 in the "ON" position.

Referring specifically now to FIGS. 3 and 7, side views of operating mechanism 28 and cassette 24 (which is typically the same for cassettes 22 and 26) in the "OFF" and "ON" positions, respectively, are provided. Cassette 24 includes a line side contact strap 38 and a load side contact strap 40 for connection with a power source and a protected circuit, respectively. Line side contact strap 38 includes a stationary contact 42 and load side contact strap 40 includes a stationary contact 44.

Cassette 24 further includes a movable contact arm 46 having a set of contacts 48 and 50 that mate with stationary contacts 42 and 44, respectively. In the "OFF" position of operating mechanism 28, contacts 48 and 50 are separated from stationary contacts 42 and 44, thereby preventing current from flowing through contact arm 46.

Contact arm 46 is mounted on a rotor structure 52 that houses one or more contact springs (not shown). Contact arm 46 and rotor structure 52 pivot about a common center 53. Cross pins 30 and 32 interface through a pair of openings 55 and 56, respectively, within rotor structure 52.

Figure 4:
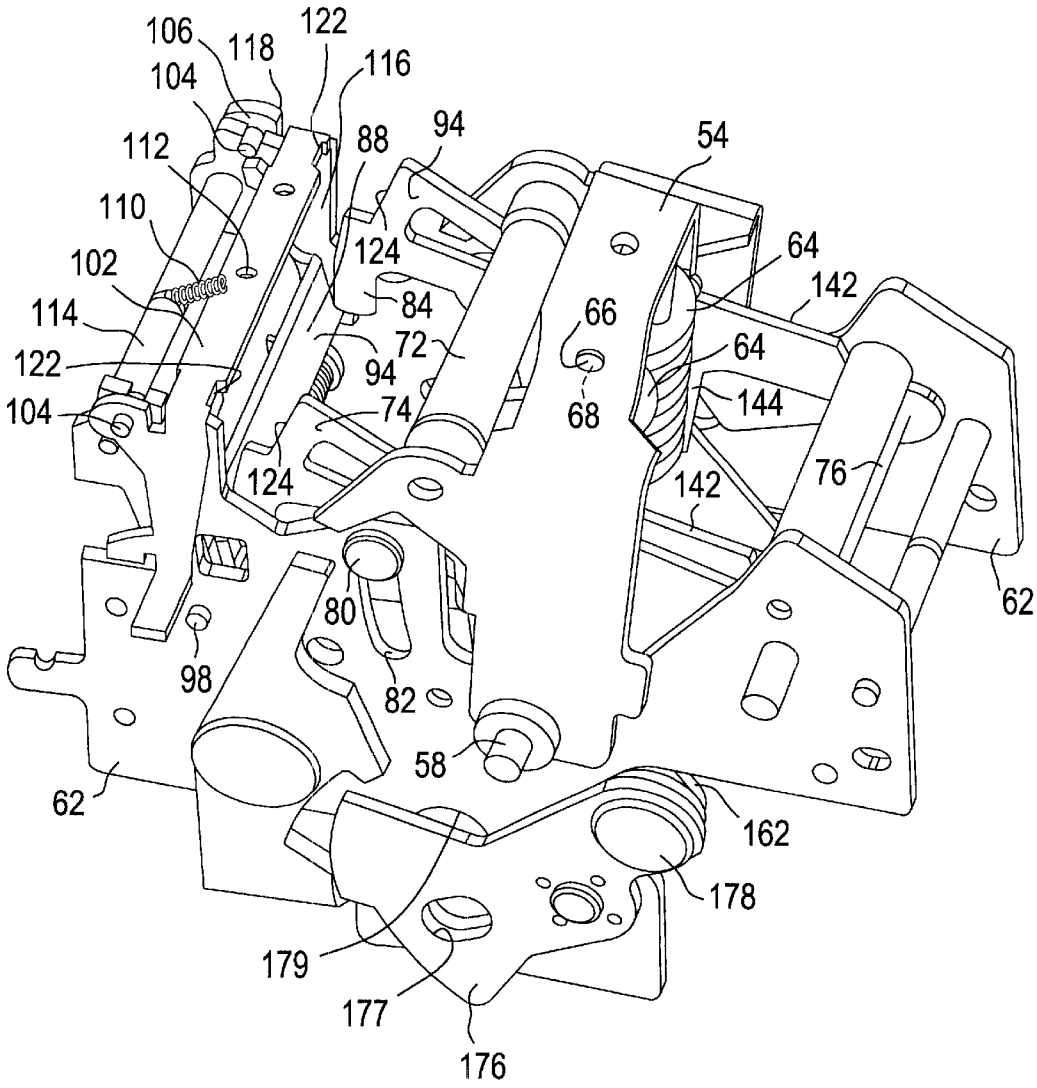
FIG. 4 is isometric view of a circuit breaker operating mechanism in the "TRIPPED" position.
Figure 5:
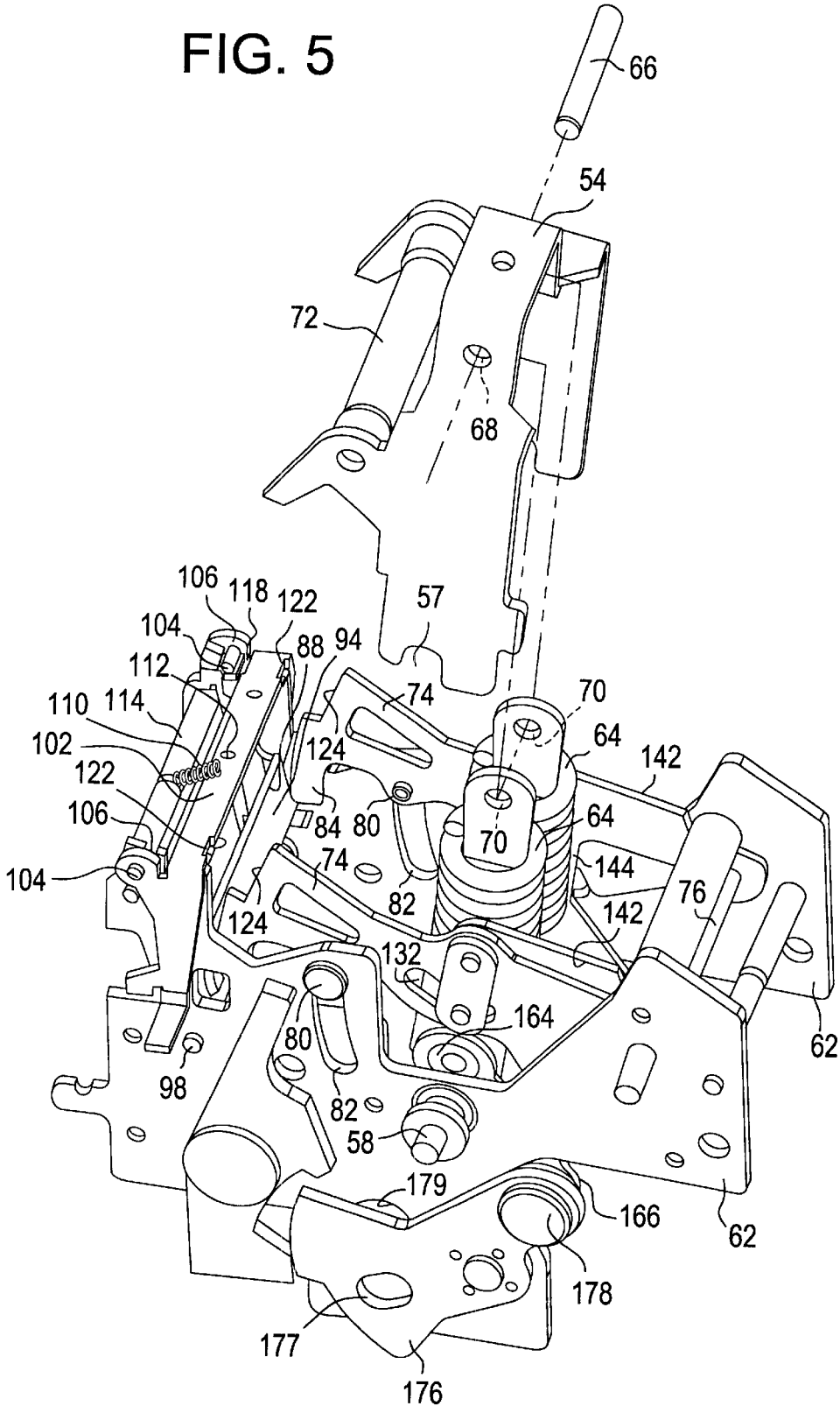
FIG. 5 is a partially exploded view of the circuit breaker operating mechanism shown in FIG. 4.
Figure 6:
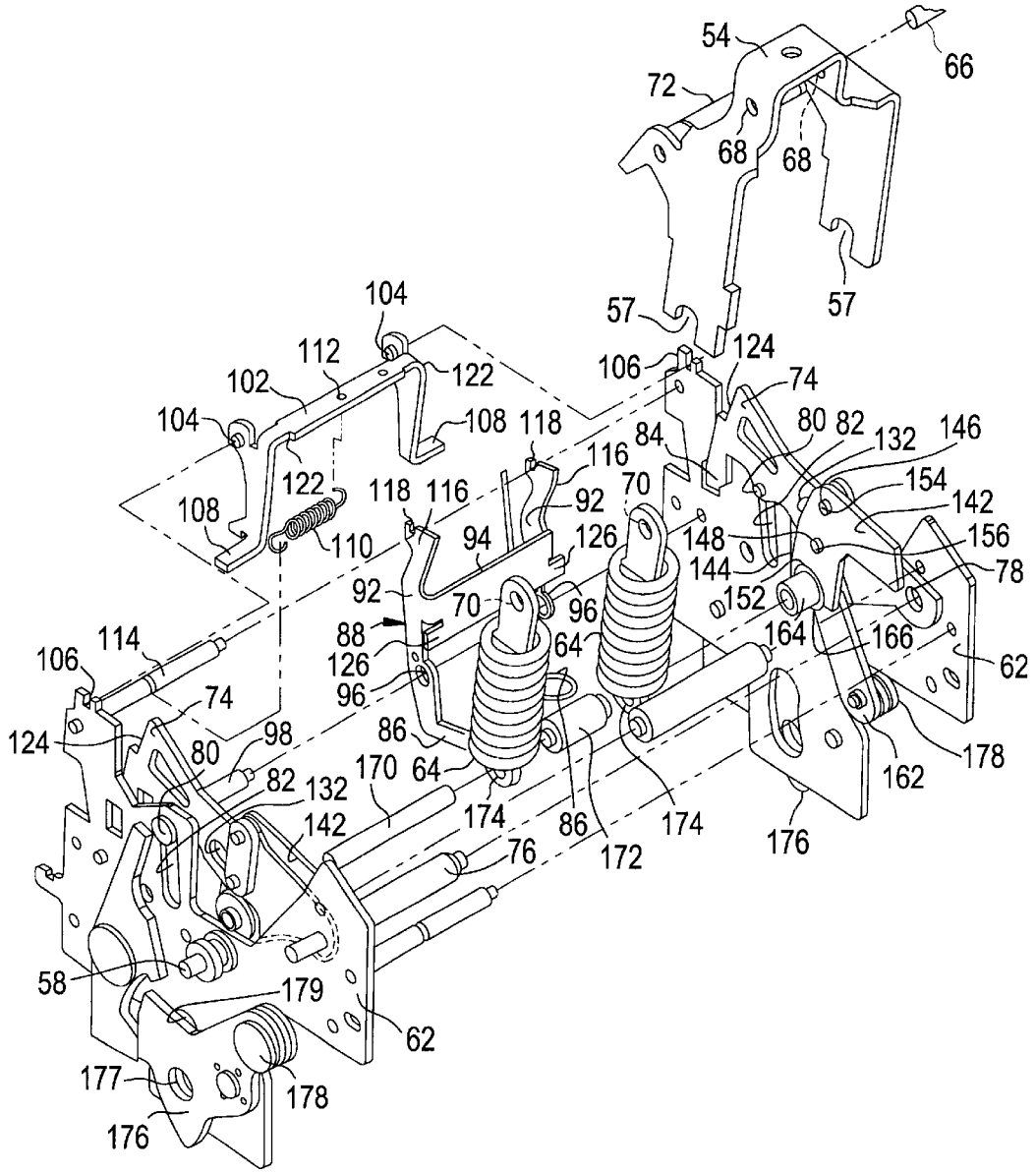
FIG. 6 is exploded view of the circuit breaker operating mechanism shown in FIGS. 4 and 5.

Referring still to FIG. 3, and also to FIGS. 4–6, toggle 34 is interconnected with a handle yoke 54. As oriented in FIG. 3, toggle 34 is in the "OFF" position by being rotated to the left. Handle yoke 54 includes U-shaped portions 57 that are rotatably positioned on a pair of pins 58 protruding outwardly from a set of side frames 62.

Handle yoke 54 is connected to powerful mechanism springs 64 by a spring anchor 66 generally supported within a set of openings 68 in handle yoke 54 and arranged through a set of openings 70 on the top portion of mechanism springs 64.

A pair of cradles 74 are disposed adjacent to side frames 62 and pivot on a pin 76 disposed through an opening 78 approximately at the end of each cradle 74. When handle yoke 54 is rotated to reset operating mechanism 28 (counterclockwise as oriented in the Figures) about pins 58, a roller pin 72 pushes each cradle 74. The movement of each cradle 74 is guided by a rivet 80 disposed through a arcuate slot 82 within each side frame 62. When cradles 74 are pushed by roller pin 72, arms 84 on each of cradles 74 drive a set of bent legs 86 depending from a primary latch 88.

Primary latch 88 includes a pair of side portions 92 (having bent legs 86 at the lower portion thereof) interconnected by a central portion 94. Each side portion 92 includes an opening 96 positioned so that primary latch 88 is rotatably disposed on a pin 98, pin 98 having each end secured to each side frame 62. The motion transmitted from cradles 74 causes primary latch 88 to rotate clockwise about pin 98.

A secondary latch 102 is positioned to straddle side frames 62. Secondary latch 102 is pivotally mounted upon frames 62 via a set of pins 104 that are disposed in a complementary pair of notches 106 on each side frame 62. Secondary latch 102 includes a pair of secondary latch trip tabs 108 that extend perpendicularly from operating mechanism 28 as to allow an interface with, for example, an actuator (not shown), to release the engagement between primary latch 88 and secondary latch 102, described below.

Secondary latch 102 is biased in the clockwise direction due to the pulling forces of a spring 110. Spring 110 has a first end connected at an opening 112 upon secondary latch 102, and a second end connected at a frame cross bar 114 disposed between frames 62. When primary latch 88 is rotated in the clockwise direction due to the reset motion of handle yoke 54, a set of upper side portions 116 at the top end of side portions 92 of primary latch 88 will be driven past secondary latch 102, allowing secondary latch 102 to rotate clockwise into a latched position by action of spring 110.

Each upper side portion 116 has a latch surface 118. Latch surfaces 118 align with a corresponding set of latch surfaces 122 on secondary latch 102. Furthermore, a set of cradle latch surfaces 124 will be positioned under a complementary set of extensions 126 depending outwardly from central portion 94 of primary latch 88.

Therefore, when the reset force upon handle yoke 54 is released, latch surfaces 118 will rest against latch surfaces 122, and extensions 126 will rest against cradle latch surfaces 124. In this position, when the reset force is released, the operating mechanism is in the "OFF" position, as seen in FIG. 3, where the contacts of cassettes 22, 24 and 26 are separated so that current does not flow.

An arcuate shaped slot 132 is positioned intermediate to opening 78 and rivet 80 on each cradle 74. An opening 134 is positioned above slot 132. When cradles 74 are moved, motion is transmitted to an upper link 142.

Upper link 142 generally has a right angle shape. A substantially vertical leg 144 of upper link 142 has a pair of openings 146, 148 and a U-shaped portion 152. Opening 148 is intermediate to opening 146 and U-shaped portion 152. Upper link 142 is connected to cradle 74 via a rivet pin 154 disposed through opening 134 and opening 146, and a rivet pin 156 is disposed through slot 132 and opening 148.

Upper link 142 is interconnected with a lower link 162 at the interface of U-shaped portion 152 and a side tube 164. Side tube 164 is a tube disposed between mechanism springs 64 and lower link 162. The outer end periphery of side tubes 164 are positioned through an openings 166 at one end of each lower link 162. A pin 170 is disposed through a tube 172, tube 172 being positioned between a pair of openings 174 at the lower portion of mechanism springs 64. Pin 170 is disposed through side tubes 164 creating a common interface between upper link 142, lower link 162, side tubes 164, and mechanism springs 64. Therefore, each side tubes 164 is a common pivot point for upper link 142, lower link 162 and mechanism springs 64.

At approximately the end of lower link 162 opposite the end having opening 166, each lower link 162 is interconnected with a crank 176 via a pivotal rivet 178. Crank 176 has an opening 177 where cross pin 30 passes through to control cassettes 22, 24 and 26. Cross pin 30 also passes through a set of arcuate slots 179 on each side frame 62. In the "OFF" position, cross pin 30 is held at the lower end of arcuate slot 179 by crank 176. Furthermore, lower link 162 and upper link 142 are positioned generally at an angle to each other, i.e., collapsed.

Referring to FIGS. 4–6, and also to FIG. 7, toggle 34 is urged in the clockwise direction to turn the circuit breaker "ON". The driving force on toggle 34, often imparted by a motorized mechanism similar to charging mechanism 36, must be high enough to rapidly overcome mechanism springs 64. The force provided to mechanism springs 64 causes pin 170 to drive side tube 164 to the extended position where vertical leg 144 of upper link 142 and lower link 162 are in line. When the line of forces generated by mechanism springs 64 (i.e., between spring anchor 66 and pin 170) is beyond side tube 164 in the clockwise direction (i.e., the over center position), upper link 142 and lower link 162 become aligned. This causes crank 176 to rotate counter clockwise thereby driving cross pin 30 to the upper end of arcuate slot 179 and rotating contact arm 46 within rotor structure 52 clockwise about center 53 to the point where contacts 48 and 50 are mated with stationary contacts 42 and 44 and current is allowed to flow through contact arm 46.

Referring now to FIGS. 1–2 and 8–10, the blocking apparatus of the present invention will now be described.

Frame 12 is secured to mid cover 14 to house the components of the blocking apparatus and to provide an anchor point for components. A connecting link 182 is disposed between cross pin 32 and a release assembly 184. Generally, connecting link 182, by holding contact arm 46 via connection with cross pin 32, prevents movable contacts 48 and 50 from mating with stationary contacts 42 and 44 until connecting link 182 is released by release assembly 184.

Connecting link 182 is an elongated member having a first end portion 186 and a second end portion 188. First end portion 186 includes an opening 192 where cross pin 32 interfaces connecting link 182. In the embodiment detailed, opening 192 is configured as a C-shaped hook (e.g., to facilitate installation when circuit breaker 10 has been assembled).

The motion of connecting link 182 is restricted to movement in one direction by a latch guide 198 which forms a longitudinal channel 202. The longitudinal channel 202 in turn slideably retains the second end portion 188 therethrough, enabling connecting link 182 to move generally in a predetermined vertical track. Second end portion 188 further includes a recess 204, which is interfaced by release assembly 184 as described herein.

Release assembly 184 comprises an actuating mechanism 206 electrically connected via wires 207 to, for example, a power source and a switch device (not shown). Actuating mechanism 206 includes a retractable lever 208. Lever 208 is connected to a link arm 210. Link arm 210 is interconnected with frame 12 by a spring 214. A latch roller 216 is further included on link arm 210 and is configured and positioned to hold connecting link 182 by being seated within recess 204.

Spring 214 provides a force upon link arm 210 to rotate it clockwise about a latch pivot 218. Latch pivot 218 pivotally supports link arm 210 on frame 12. This clockwise rotation causes latch roller 216 to be urged within recess 204.

Figure 8:
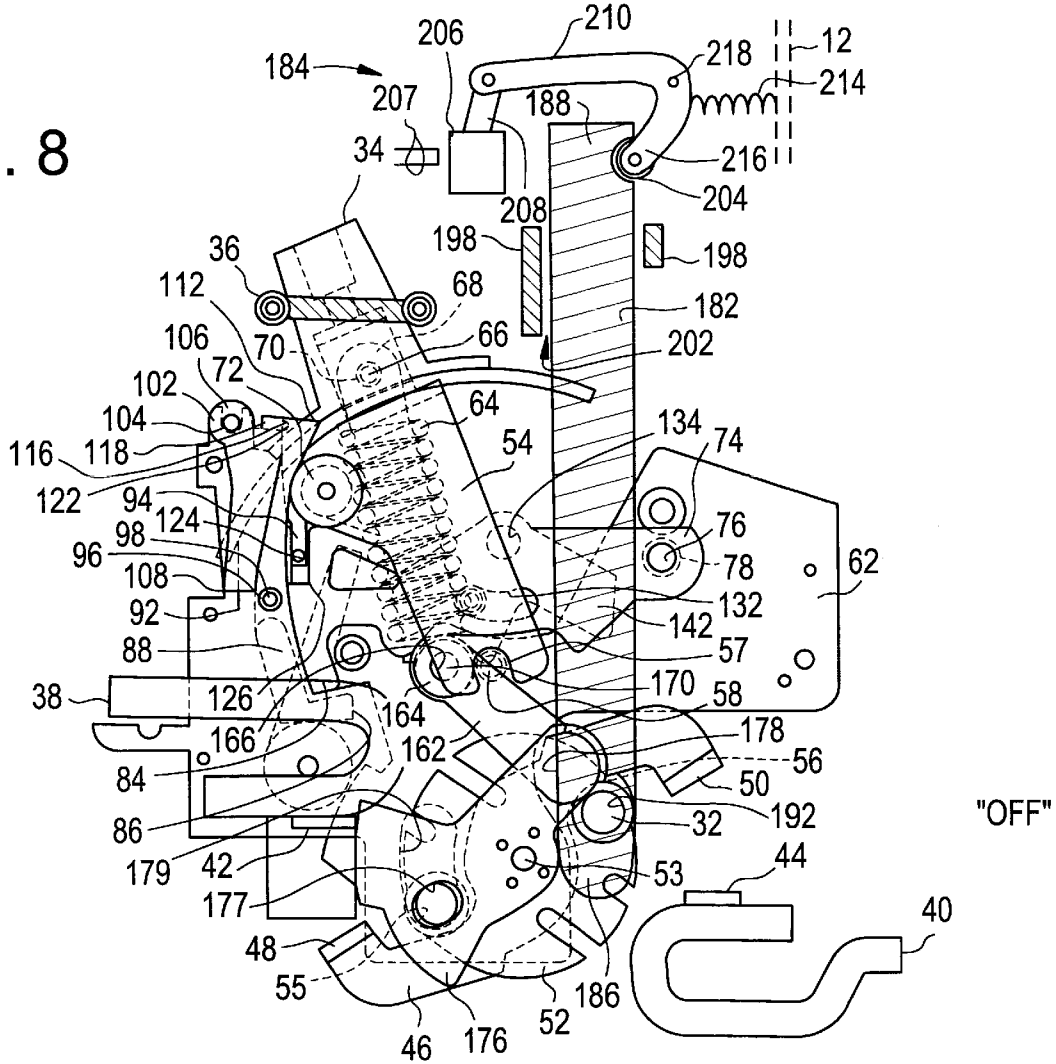
FIG. 8 is a sectional view of a circuit breaker in the "OFF" position including a blocking apparatus installed.

Therefore, and as shown in FIG. 8, when the circuit breaker is in the "OFF" position, latch roller 216 is positioned within recess 204 thereby holding connecting link 182. Mechanism operating springs 64 are discharged as described above with respect to FIG. 3. Mechanism operating springs 64 maintain contact arm 46 in the counterclockwise position.

Figure 9:
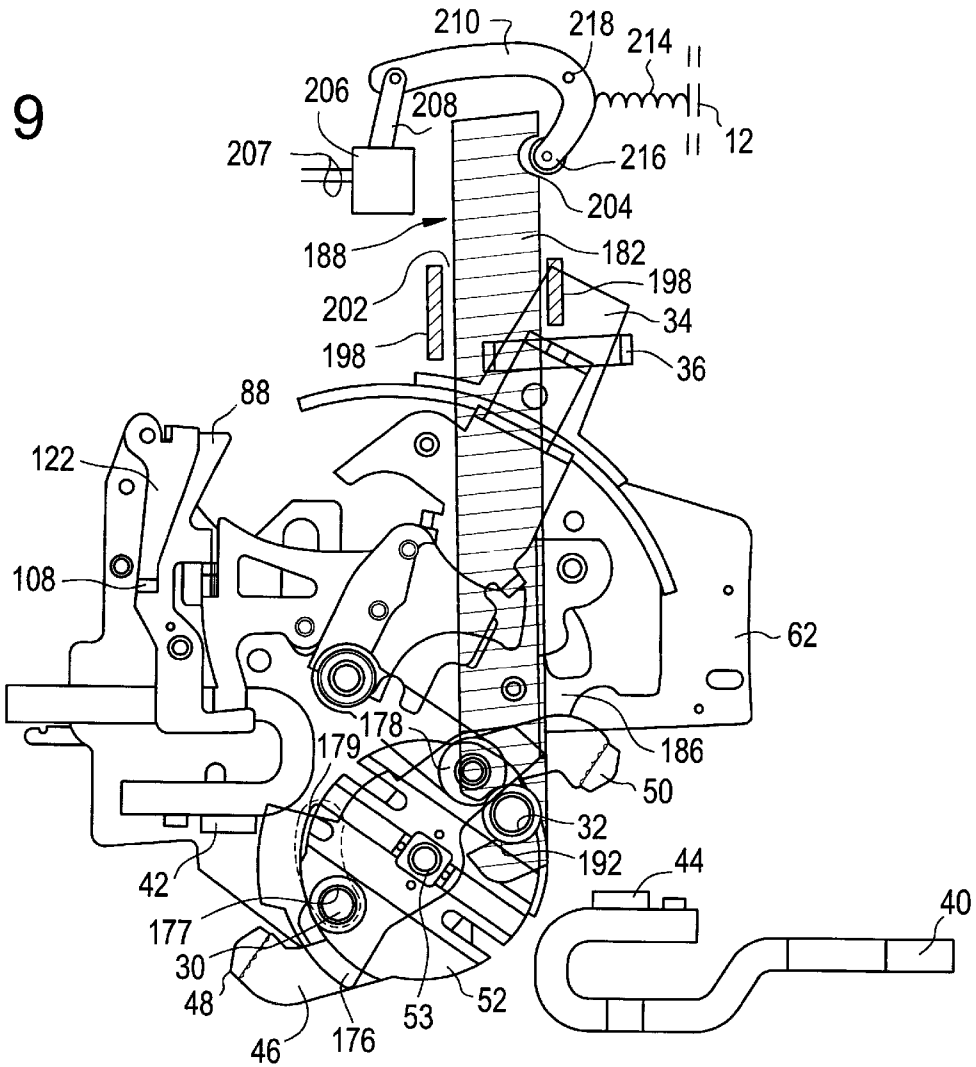
FIG. 9 is a sectional view of the circuit breaker of FIG. 8 in the "ON" position and having the contacts separated.

Referring now to FIG. 9, toggle 34 is driven to the right, for example, by charging mechanism 36, against the resistance of mechanism operating springs 64. In this configuration, toggle 34 is in the "ON" position. However, because of the positioning of latch roller 216 within recess 204, connecting link 182 holds cross pin 32 and prevents contact arm 46 from rotating in the clockwise direction to cause contacts 48 and 50 to mate with stationary contacts 42 and 44 (i.e., the contacts are open). It should be noted that the rate at which charging mechanism 36 rotates toggle 34 is immaterial, since the contacts are being held open.

Figure 10:
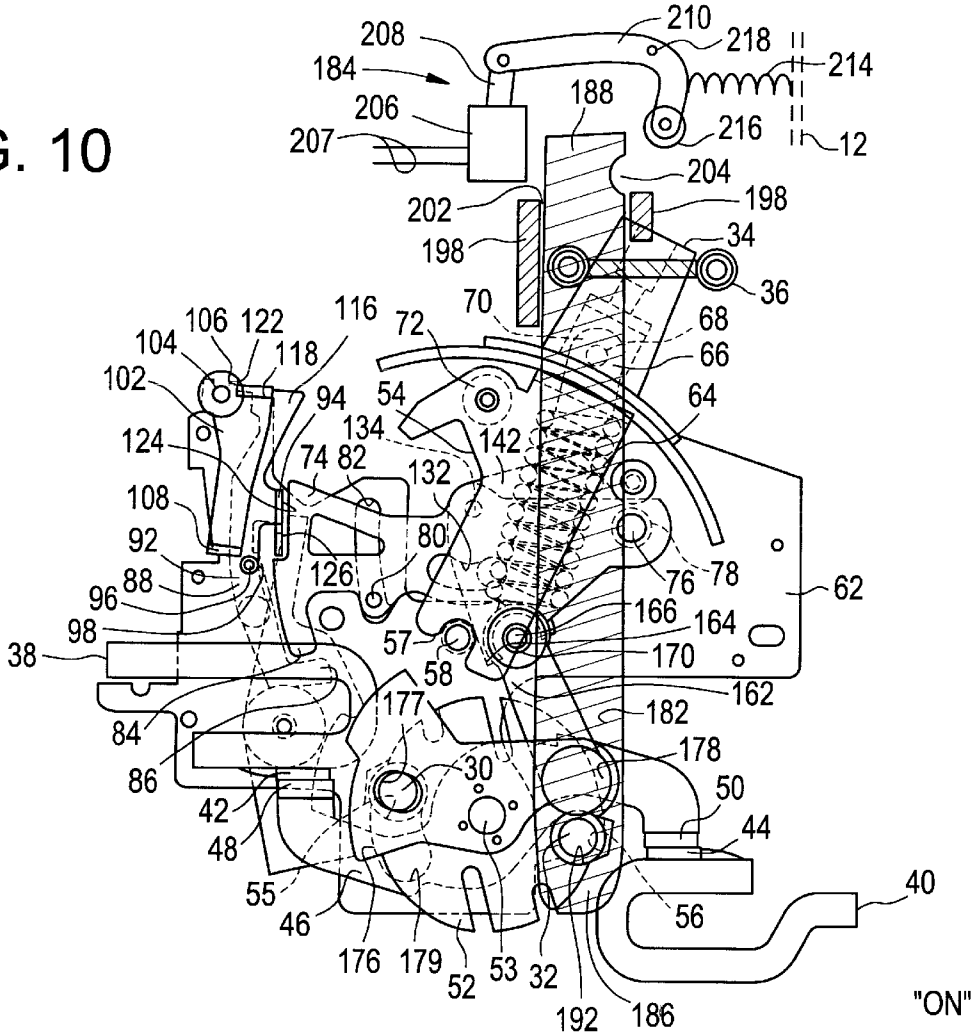
FIG. 10 is a sectional view of the circuit breaker of FIGS. 8 and 9 in the "ON" position.

Referring now to FIG. 10, actuating mechanism 206 causes lever 208 to retract. The retraction of lever 208 in turn causes link arm 210 to rotate in the counterclockwise direction about latch pivot 218. The counterclockwise rotation of link arm 210 compresses spring 214 thereby causing latch roller 216 to decouple from recess 204 of connecting link 182. Therefore, connecting link 182 is no longer maintained by release assembly 184 and is free to be carried by the tendencies of mechanism operating springs 64 to drive cross pin 32 via crank 176, causing rotor structure 52 and contact arm 46 to rotate clockwise about center 53 and movable contacts 48 and 50 to mate with stationary contacts 42 and 44. In this position, the contacts are closed and circuit breaker 10 is in the "ON" position.

When the circuit breaker trips, for example, due to action imparted to secondary latch 102, which sets other operating mechanism 28 components in motion to displace crank 176 as described generally above, rotor structure 52 and contact arm 46 rotate counterclockwise about its center 53. This causes cross pin 32 to move from the position of FIG. 10 to the position of FIG. 8, thereby pushing connecting link 182 up within channel 202. By extending lever 208 from actuating mechanism 206, link arm 210 rotates clockwise about pivot 218 and latch roller 216 engages recess 204. In this condition, the blocking apparatus embodied by the present invention is in the position as shown in FIG. 8, wherein a driving force applied to toggle 34 will set operating mechanism 28 in the "ON" position while maintaining movable contacts 48 and 50 apart from stationary contacts 42 and 44.

One apparent benefit of the blocking apparatus embodied by the present invention relates to the provision of a driving force to toggle 34, for example by charging mechanism 36. A rapid closure of contact arm 46 is typically desired. Without the blocking apparatus embodied by the present invention, a strong driving force must be applied quickly in order to overcome the force of mechanism operating springs 64 and rapidly close contact arm 46. With the inclusion of the blocking apparatus herein, a driving force may be applied to toggle 34 by a slower charging mechanism 36. Therefore, after the driving force is applied to toggle 34, the desired rapid closure is effectuated by releasing latch roller 216 from recess 204 as described herein.

An apparent benefit of the present invention is that the blocking apparatus; i.e., connecting link 182 and release assembly 184, may be installed either in the factory and provided integrally with the circuit breaker, or may be field installed. The blocking apparatus is easily field installed, for example by arranging opening 192 of connecting link 182 on cross pin 32 and mounting frame 12 and the apparatus components on the breaker mid cover 14.

Another apparent benefit is that the amount of motion required to allow current to pass through is minimized. By pre-charging mechanism springs 64, the contacts can be rapidly closed by releasing contact arm 46 via connecting link 182.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for blocking a movable contact from connection with a stationary contact in a circuit interrupter contact structure, said circuit interrupter contact structure having an operating mechanism that provides a closing force to move said movable contact into connection with said stationary contact, said apparatus comprising:

a link connected to said movable contact, said link moving between a first position and a second position, said first position holding the movable contact away from said stationary contact against said closing force and said second position releasing said movable contact to allow said closing force to move said movable contact into connection with said stationary contact.

2. The apparatus as in claim 1, said circuit interrupter contact structure being a rotary contact structure.

3. The apparatus as in claim 2, said operating mechanism controlling said rotary contact structure with a cross pin, said cross pin being coupled to said link.

4. The apparatus as in claim 3, wherein said link is caused to move between said first position and said second position by an actuating mechanism.

5. The apparatus as in claim 4, wherein said actuating mechanism is connected to an arm that interfaces said link.

6. The apparatus as in claim 5, wherein said link includes a recess, said arm interfacing said link at said recess.

7. The apparatus as in claim 6, said arm being connected to a spring to provide a bias toward said recess.

8. The apparatus as in claim 7, said arm further including a roller, said roller configured to seat within said recess.

9. The apparatus as in claim 1, said operating mechanism further comprising a handle, said handle being controllable by a charging mechanism.

10. An apparatus for adding to a circuit interrupter, said circuit interrupter having a contact structure including a movable contact and a stationary contact, said apparatus blocking said movable contact from connection with said stationary contact, said contact structure having an operating mechanism that provides a closing force to move said movable contact into connection with said stationary contact, said apparatus comprising:

a link connected to said movable contact, said link moving between a first position and a second position, said first position holding said movable contact away from said stationary contact against said closing force and said second position releasing said movable contact to allow said closing force to move said movable contact into connection with said stationary contact.

11. The apparatus as in claim 10, said contact structure being a rotary contact structure.

12. A method for blocking a contact structure in a circuit interrupter, said circuit interrupter contact structure having a movable contact and a stationary contact, said circuit interrupter contact structure having a closed position wherein said movable contact and said stationary contact are mated and an open position wherein said movable contact and said stationary contact are separated, and said circuit interrupter contact structure being controllable by an operating mechanism, said operating mechanism including an on position and an off position, said on position corresponding with said operating mechanism providing a force that urges said movable contact in the direction of said closed position, and said off position corresponding with said operating mechanism providing a force that urges said movable contact in the direction of said open position, said method comprising:

moving said operating mechanism to said on position;

holding said movable contact in said open position while said operating mechanism is in said on position; and releasing said movable contact.

13. A method as in claim 12, said movable contact further being interfaced by a link, said link having a first position and a second position, said first position corresponding with said open position of said circuit interrupter contact structure and said second position corresponding with said closed position of said circuit interrupter contact structure, wherein said holding of said movable contact in said open position while said operating mechanism is in said on position is effectuated by holding said link in said first position, and further wherein releasing said movable contact is effectuated by releasing said link allowing said link to move to said second position.

14. A method as in claim 13, wherein said link includes a recess, said recess being engaged by a roller when said link is in said first position and said recess being released by said roller when said link is in said second position.

15. A method as in claim 14, wherein said roller engages said recess with a spring providing a holding force.

16. A method as in claim 15, wherein said roller releases said recess with an actuating mechanism, said actuating mechanism providing a release force opposing said holding force.

* * * * *